US008122825B2

(12) United States Patent
Schwanke

(10) Patent No.: US 8,122,825 B2
(45) Date of Patent: Feb. 28, 2012

(54) SCREENPRINTING DEVICE AND METHOD FOR THE PRODUCTION THEREOF

(75) Inventor: Dieter Schwanke, Hof (DE)

(73) Assignee: Biotronik CRM Patent AG, Baar (CH)

( * ) Notice: Subject to any disclaimer, the term of this patent is extended or adjusted under 35 U.S.C. 154(b) by 710 days.

(21) Appl. No.: 12/043,119

(22) Filed: Mar. 5, 2008

(65) Prior Publication Data

US 2008/0216682 A1 Sep. 11, 2008

(30) Foreign Application Priority Data

Mar. 7, 2007 (DE) ..... 10 2007 010 936

(51) Int. Cl.
*B41C 1/14* (2006.01)
*B41L 13/00* (2006.01)

(52) U.S. Cl. ..... 101/128.4; 101/127; 101/129

(58) Field of Classification Search ..... 101/128.4
See application file for complete search history.

(56) References Cited

U.S. PATENT DOCUMENTS

| | | | | |
|---|---|---|---|---|
| 2,790,726 | A * | 4/1957 | Dietrich | 101/128.21 |
| 3,008,601 | A * | 11/1961 | Cahne | 220/573.2 |
| 3,672,934 | A * | 6/1972 | Larry | 101/128.4 |
| 3,951,060 | A * | 4/1976 | Crystal | 101/150 |
| 4,088,073 | A | 5/1978 | Crystal et al. | |
| 4,718,340 | A * | 1/1988 | Love, III | 101/116 |
| 5,460,316 | A | 10/1995 | Hefele | |
| 6,368,897 | B1 * | 4/2002 | Jiang et al. | 438/118 |
| 7,152,530 | B2 * | 12/2006 | Schmohl et al. | 101/467 |
| 2001/0053415 | A1 | 12/2001 | Jiang et al. | |
| 2006/0102025 | A1 * | 5/2006 | Wittemann | 101/129 |

FOREIGN PATENT DOCUMENTS

| | | |
|---|---|---|
| AT | 3 06 64 | 2/1970 |
| DE | 197 38 873 | 9/1997 |
| DE | 102 31 698 | 10/2003 |
| DE | 10 2004 055 113 | 11/2004 |
| DE | 10 2005 045 350 | 9/2005 |
| EP | 1 147 887 | 10/2001 |
| EP | 1 657 594 | 5/2006 |

OTHER PUBLICATIONS

German Search Report, dated Aug. 24, 2009.
European Search Report, dated Oct. 1, 2010.

* cited by examiner

*Primary Examiner* — Jill Culler
(74) *Attorney, Agent, or Firm* — ARC IP Law, PC; Joseph J. Mayo

(57) ABSTRACT

The present invention relates to a screenprinting device having a fabric and a template situated on the fabric. The fabric and/or the template each have a coating which reduces the adhesion of a screenprinting paste or a screenprinting ink to the fabric and/or to the template. In this way, finer structures may be generated, in particular in regard to electronic elements during the production of circuits using multilayer technology. Furthermore, the present invention describes a method for producing a corresponding screenprinting device.

10 Claims, 1 Drawing Sheet

SCREENPRINTING DEVICE AND METHOD FOR THE PRODUCTION THEREOF

This application takes priority from German Patent Application DE 10 2007 010 936.0, filed 7 Mar. 2007, the specification of which is hereby incorporated herein by reference.

BACKGROUND OF THE INVENTION

1. Field of the Invention

The present invention relates to a screenprinting device having a fabric and a template situated in the fabric in the form of a photolithographically structured emulsion. The present invention also relates to a method for producing a screenprinting device of this type.

2. Description of the Related Art

Screenprinting is a printing method in which a printing ink or printing paste is pressed using a knife-like tool, the rubber squeegee (printing squeegee), through a fine-meshed fabric onto the material to be printed. Screenprinting is therefore also referred to as the through printing method. At the point of the fabric at which no ink is to be printed in accordance with the motif, the mesh openings of the fabric are impermeable to the printing ink or printing paste due to a template (e.g., photolithographically structured emulsion) situated on the fabric.

In addition to use in the field of advertisement and inscription, and in textile or ceramic printing, screenprinting is currently also frequently employed for printing circuits in the field of hybrid technology, for example, in the field of multilayer ceramic technology. An example of a multilayer ceramic technology is the so-called LTCC technology (LTCC=Low Temperature Cofired Ceramics), which represents a cost-effective technology for producing multilayer circuits on the basis of sintered ceramic carriers, which contain wiring levels connected by z contacts, so-called vias, in multiple layers. In LTCC technology, the circuit elements are applied using screenprinting to the green films of the later ceramic carrier, which are then stacked and sintered.

Modern packaging development currently demands the printing of finer structures (ultrafine line structures), regardless of the area of use, to save installation space or to minimize the consumption of high-cost pastes. In addition, modern high-frequency technology requires narrow printed conductor widths as a function of the usage frequency, which are predefined by extensive simulations based on losses and given impedances. It is therefore desirable to print finer structures. In addition, if it is possible to print finer structures, multilayer technology processes such as LTCC may replace circuits which have been produced up to this point using thin-film technology. Thin-film technology has been used up to this point in the area of high-frequency circuits in the ultrahigh frequency range to implement HF-capable structures because of its high structural resolution. This technology is implemented by deposition and etching procedures. It requires the use of very flat, pretreated, and high-cost substrates. In addition, the thin-film process per se is a costly method. Thin-film structures may additionally only be implemented in a coplanar manner on the substrate surface. The use of the multilayer technology having ultrafine line structures may provide a significant cost reduction in relation to thin-film technology and additionally offer the advantage of the use of multiple levels, inter alia, also for shield layers.

For screenprinting in the field of multilayer technology (thick-film technology), the screenprinting frame is usually made of aluminum and is covered by a steel fabric, using which the elastic deflection of the screen required during the printing procedure may be achieved. An elastic deflection of the screen during the printing procedure is necessary for the so-called lift-off, i.e., for the distance which may be implemented between fabric and substrate to be printed. Too little lift-off may result in cloudiness in the print, for example, because the fabric does not immediately detach from the printed paste film behind the squeegee—it remains "stuck" in the printed paste. Too much lift-off, in contrast, increases the fabric tension, which on one hand results in the elastic proof stress of the fabric being exceeded and thus the fabric aging prematurely, and, on the other hand, may result in blotted prints because of paste spray, so that the template edge may no longer draw a clean printed image.

The wire thickness of the fabric used is currently between approximately 30 μm and 16 μm. The permeability of the fabric is described by its mesh width, which is specified using the so-called mesh count. For example, 325 mesh means that there are 325 meshes per square inch.

The template is frequently produced as a direct template using a photographic method. For this purpose, the fabric is coated using photosensitive polymers, which are exposed using the desired structures. Subsequently, the exposed structures are developed and the unexposed areas are washed out. The fabric, the template (emulsion), and the printing frame together form the screenprinting screen.

During printing, the printing paste is applied to the screen and distributed uniformly onto the structured screen using a so-called flood bar. Subsequently, the actual printing procedure is performed, the printing squeegee being drawn over the screen using an appropriately tailored hardness. The screen is located at a specific distance from the substrate to be printed, such as an LTCC film, during this printing procedure. The screen is pressed elastically downward in the direction of the substrate to be printed using the printing squeegee. Shearing of the printing paste occurs simultaneously using the printing squeegee, which reduces its viscosity during the shearing because of its thixotropic property and may thus be pressed through the openings of the screenprinting screen. After the shear strain is ended, the printing paste has the starting viscosity again.

If smaller resolutions of the printed structures (ultrafine line structures) are to be achieved, i.e., a resolution less than 50 μm or even less than 30 μm, the problem results that for this purpose, the fabric and the template must accordingly have fine structures having small openings and these fine structures and small openings in the template and the fabric inhibit the ink or paste flow through the screenprinting screen.

The problem of increasing the register accuracy during screenprinting is solved in DE 197 38 873 A1. Moreover, the publication concerns itself with the question of optimizing the printing quality with fine strokes and rasters for plastic fabric. The plastic threads of the fabric are coated by a mantle layer which is vapor deposited or sputtered on, and which is in turn covered by a metal topcoat, which carries the emulsion of the template and results through galvanization. The mantle layer is generated using a vapor deposition or sputtering process having a layer thickness of approximately 5 nm to greater than 200 nm. The application of the mantle layer is performed using galvanic deposition. For example, a copper or nickel layer is applied. The metal-plated plastic fabric causes a highly reproducible template quality having excellent boundary sharpness and exact color metering, because it ensures extremely minimal stretching with sufficient basic consistency. The fabric known from this publication thus does not solve the problem specified above, because it relates to a plastic fabric and not to a steel fabric, which is used for printing circuit elements. In addition, the production method for a screenprinting device specified in the publication DE 197 38 873 A1 is very complex and costly.

The publication DE 10 2004 055 113 A1 discloses a method for hydrophilizing the screenprinting template carriers, which significantly improves the wetting of the screenprinting template carrier with template material. During the hydrophilizing of the screenprinting template carrier, i.e., the screenprinting fabric, it is provided with ultra-fine divided oxide particles, such as nanometer particles made of metal oxide, for example, titanium oxide, aluminum oxide, or zirconium oxide, and a wetting agent. For example, a surfactant may be used as the wetting agent. Alternatively thereto, the hydrophilizing agent may also be used during the removal of template material from the screenprinting fabric, preferably in that it is added to the layer removal liquid. During the layer removal of the screenprinting template carrier, in which it is prepared for the production of a new screenprinting screen having a new template, the screenprinting template carrier is not only freed of the template material, but rather simultaneously also hydrophilized for the next coating procedure. Therefore, the coating of the screenprinting fabric specified in this publication also does not solve the problem disclosed above of generating finer structures.

BRIEF SUMMARY OF THE INVENTION

The object of the present invention is therefore to specify a screenprinting device which allows the printing of finer structures. In addition, the object of the present invention comprises specifying a method for producing a screenprinting device which allows the printing of finer structures, in particular for a steel fabric, simply and cost-effectively.

The object is achieved according to the present invention by a screenprinting device in which the fabric and/or the template each have a coating on the surface which reduces the adhesion of a screenprinting paste or a screenprinting ink to the fabric and/or to the template.

According to the present invention, the obstruction of the flow or passage of the screenprinting paste or the screenprinting ink through the fabric mesh and/or the openings in the template is reduced by the specified coating, so that a fabric having a smaller mesh width and/or a template having smaller openings may be used and in this way finer structures may be generated. The effect of the reduced adhesion of the screenprinting paste or the screenprinting ink to the fabric and/or the template is also referred to as the Lotus effect.

DETAILED DESCRIPTION OF THE INVENTION

Figure 1:
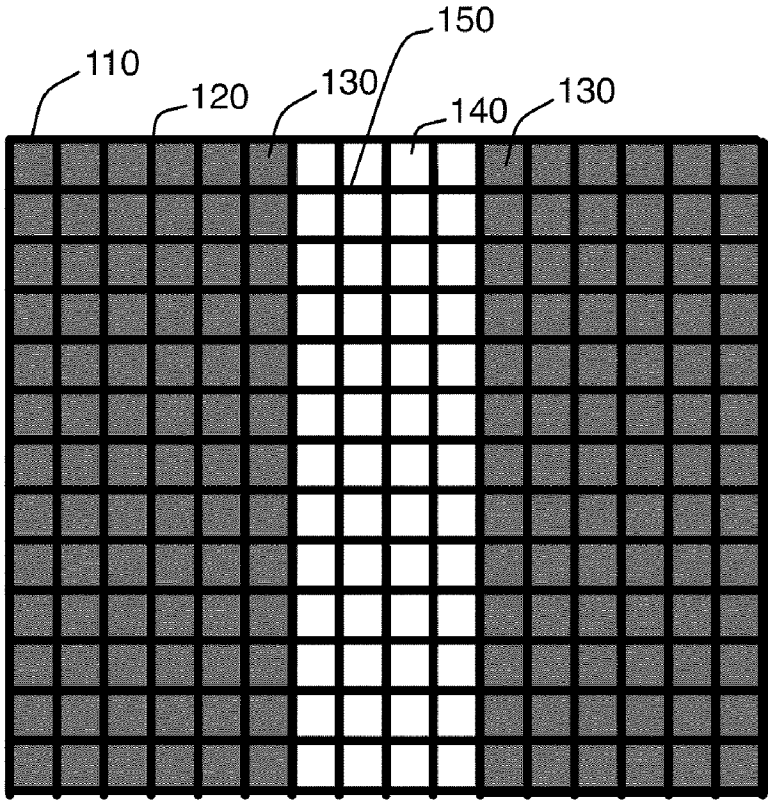
FIG. 1 shows the fabric having a mesh with overlying template having an open area where ink passes through the template and mesh for printing.

The anti-adhesion coating 150 is particularly simply achieved using a nanocrystalline coating, which preferably has crystals having a diameter of less than 10 nm, or an amorphous coating. A coating of this type additionally has the advantage that it may be applied very thinly, so that it essentially causes no additional change of the mesh width or the opening width of the template. FIG. 1 shows fabric 110 having mesh 120 with template 130 having open area 140 where ink passes through template 130 and mesh 120 for printing.

A carbon compound having a diamond-like structure (DLC) and/or a fluoride and/or a fluorine-based compound, preferably Teflon (polytetrafluoroethylene, PTFE), and/or a silicon-based compound may be used as an especially suitable coating material for the coating.

In a further preferred exemplary embodiment, the screenprinting device has a coating of a layer thickness between approximately 100 nm and approximately a few micrometers. These layer thicknesses are sufficiently thick to ensure with high consistency the easier passage of the screenprinting ink or the screenprinting paste through the fabric match and/or the template openings on one hand, and to allow the printing of ultrafine line structures on the other hand.

In an especially preferred exemplary embodiment, the coating is oleophilic (hydrophilic, lipophilic) on the top side of the fabric and/or the template, i.e., on the side of the fabric and/or the template facing away from the substrate to be printed, to achieve a rolling movement and thus good shearing through the adhesion of the paste, to build up the thixotropy effect. The coating is implemented as oleophobic (hydrophobic, lipophobic) on the bottom side of the fabric and/or the template, i.e., on the side of the fabric and/or the template facing toward the substrate to be printed, and in the intermediate spaces of the fabric and the template, to suppress adhesion/sticking. This design of the screenprinting device causes clean distribution of the screenprinting paste or the screenprinting ink (flooding of the screen) on the top side and good detachment of the screenprinting paste or the screenprinting ink on the bottom side of the screenprinting screen after discontinuation of the shear forces applied by the squeegee.

The above object is additionally achieved by a method for producing a screenprinting device, in which the fabric, before the application of the template to the fabric, and/or the fabric and the template, after the application of the template to the fabric, are each provided on the surface with a coating which reduces the adhesion of a screenprinting paste or a screenprinting ink to the fabric or to the template.

The method according to the present invention allows the fabric having smaller mesh width and/or templates having smaller openings to be able to be used very simply and cost-effectively and in this way allows the printing of finer structures. The method according to the present invention only contains a single additional coating step for this purpose. The known method for producing a screenprinting device is thus not made significantly more costly or complicated.

An especially simple and cost-effective coating possibility is given by a coating which is implemented as nanocrystalline, preferably having a crystal diameter of less than 10 nm, or amorphous.

In a further preferred exemplary embodiment, a coating of a layer thickness between approximately 100 nm and approximately a few micrometers is generated during the production method according to the present invention. As already explained above, these layer thicknesses allow the printing of ultrafine line structures with a high consistency.

A cost-effective coating is also achievable by a coating material which contains a carbon compound having a diamond-like structure (DLC=diamond like carbon) and/or a fluoride and/or a fluorine-based compound, preferably PTFE, and/or a silicon-based compound. A further improvement of the properties of the coating may be achieved in that the fabric and/or the template is provided on its top side with an oleophilic (lipophilic, hydrophilic) coating and/or on the bottom side of the fabric and/or the template and/or the intermediate spaces of the fabric and/or the template with an oleophobic hydrophobic, lipophobic) coating.

Further goals, features, advantages, and possible applications of the present invention result from the following description of an exemplary embodiment. All features described form the subject matter of the present invention, alone or in any arbitrary combination, independently of their summary in the individual claims or what they refer back to.

Example

The steel fabric of a screenprinting device is provided, after a plasma cleaning step, using a plasma CVD method either with a silicone-like amorphous surface having approximately 100 nm layer thickness or with a DLC (Diamond Like Carbon) layer of 1 μm (e.g., trade name CARBOCER® from PLASMA ELECTRONIC GmbH). The DLC coating is significantly harder than the silicone-like coating, the latter being able to be applied at lower processing temperatures, however. The coating of the fabric is performed at a temperature of approximately 80° C. or correspondingly lower. Subsequently, the template is applied to the fabric. Alternatively, the template may additionally also be provided with this coating. The sequence is a function of the material of the template and its heat resistance.

Significantly lower deposition temperatures may be achieved using an amorphous (glass-like) coating. This silicone-like surface has the advantage of lower processing temperature, but only has a surface hardness lower than glass. 40° C. is desirable for this deposition, in comparison to 80° C. for DLC layers, which in turn have hardnesses approximating diamond (Mohs 9-10). All layers are deposited in the plasma CVD method. The oleophilic layers are also applied using a plasma CVD method and are similar to the DLC layers. Only another addition of doping gases changes the surface properties. Hydrogen bridges, OH groups, or carboxyl groups which form alter the surface properties in the direction of oleophilic (lipophilic/hydrophilic) or oleophobic (lipophobic/hydrophobic). Incorporation of elevated oxygen components encourages the oleophilic character of the surface. The incorporation of silicon encourages the oleophobic character. The trade name of the oleophilic (hydrophilic) coating method of PLASMA ELECTRONIC is AQUACER®

What is claimed is:

1. A screenprinting device having
a fabric comprising
a top side,
a bottom side and
intermediate spaces in openings between said top side and said bottom side wherein said intermediate spaces are configured to allow a screenprinting paste or a screenprinting ink to pass through said fabric, from said top side of said fabric to said bottom side of said fabric;
a template situated on the fabric;
wherein the fabric at the intermediate spaces comprises
a coating that comprises a nanocrystalline structure and which reduces adhesion of
the screenprinting paste or
the screenprinting ink to the fabric;
wherein said top side the fabric comprises a second coating that is oleophilic and wherein said coating on said bottom side of the fabric and in said intermediate spaces of the fabric is oleophobic;
or
wherein said top side the fabric comprises a second coating that is hydrophilic and said coating on said bottom side of the fabric and in said intermediate spaces of the fabric is hydrophobic;
or
wherein said top side of the fabric comprises a second coating that is lipophilic and wherein said coating on said bottom side of the fabric and in said intermediate spaces of the fabric is lipophobic.

2. The screenprinting device according to claim 1, wherein the nanocrystalline structure comprises a crystal diameter of less than 10 nm.

3. The screenprinting device according to claim 1, wherein the coating contains a carbon compound having a diamond-like structure or DLC and/or a fluoride and/or a fluorine-based compound, or PTFE, and/or a silicon-based compound.

4. The screenprinting device according to claim 1, wherein the coating has a layer thickness between approximately 100 nm and approximately a few micrometers.

5. A method for producing a screenprinting device according to claim 1, comprising
applying said coating that comprises said nanocrystalline structure to said bottom side and said intermediate spaces of said fabric wherein said coating reduces adhesion of said screenprinting paste or said screenprinting ink to the fabric.

6. The method according to claim 5, wherein said coating is oleophobic or lipophobic or hydrophobic.

7. The method for producing a screenprinting device according to claim 5, further comprising:
applying a second coating to said top side of the fabric wherein said second coating increases adhesion of said screenprinting paste or said screenprinting ink to the fabric to build up a thixotropy effect.

8. A screenprinting device having
a fabric comprising
a top side,
a bottom side and
intermediate spaces in openings between said top side and said bottom side;
a template situated on the fabric;
wherein the fabric at the intermediate spaces comprises
a coating which reduces adhesion of a
screenprinting paste or
a screenprinting ink to the fabric;
and,
wherein said top side of the fabric comprises
a second coating that increases adhesion of
said screenprinting paste or
said screenprinting ink to the fabric to build up a thixotropy effect.

9. The method according to claim 8, wherein said second coating is oleophilic or hydrophilic or lipophilic.

10. The method according to claim 8, wherein said coating is oleophobic or hydrophobic or lipophobic.

* * * * *